US007205963B2

(12) United States Patent
Amatsuchi

(10) Patent No.: US 7,205,963 B2
(45) Date of Patent: Apr. 17, 2007

(54) PLASMA DISPLAY PANEL

(75) Inventor: Mario Amatsuchi, Yamanashi-ken (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 208 days.

(21) Appl. No.: 10/304,690

(22) Filed: Nov. 27, 2002

(65) Prior Publication Data

US 2003/0146886 A1 Aug. 7, 2003

(30) Foreign Application Priority Data

Feb. 6, 2002 (JP) ..... 2002-029699

(51) Int. Cl.

| | |
|---|---|
| ***G09G 3/28*** | (2006.01) |
| *H01J 1/62* | (2006.01) |
| *H01J 63/04* | (2006.01) |
| *H01J 17/49* | (2006.01) |

(52) U.S. Cl. ..... 345/67; 313/484; 313/582; 345/60

(58) Field of Classification Search ..... 345/37, 345/60, 62, 66, 67

See application file for complete search history.

(56) References Cited

U.S. PATENT DOCUMENTS

| | | | | |
|---|---|---|---|---|
| 4,780,644 | A * | 10/1988 | Sakai et al. | 313/582 |
| 6,249,264 | B1 * | 6/2001 | Sano et al. | 345/60 |
| 6,252,353 | B1 * | 6/2001 | Ha et al. | 313/582 |
| 6,448,946 | B1 * | 9/2002 | Anderson et al. | 345/60 |
| 6,479,934 | B2 * | 11/2002 | Nishio | 313/586 |
| 6,541,922 | B2 * | 4/2003 | Shirozu | 315/169.4 |
| 6,683,589 | B2 * | 1/2004 | Sano et al. | 345/60 |
| 2002/0008472 | A1 * | 1/2002 | Ha | 313/582 |

* cited by examiner

*Primary Examiner*—Sumati Lefkowitz
*Assistant Examiner*—Alexander S. Beck
(74) *Attorney, Agent, or Firm*—Arent Fox LLP

(57) ABSTRACT

A plasma display panel comprises a plurality of row electrode pairs (X, Y) and a dielectric layer 12 covering the row electrode pairs (X, Y) provided on a front glass substrate 10, and also column electrodes D provided on a back glass substrate 13 to intersect with the row electrode pairs (X, Y) so as to form display discharge cells C1 in a discharge space at the intersections. A discharge area C2 is formed between the adjacent display discharge cells C1 in the column direction to provide for a discharge created between the back to back row electrodes X and Y of the adjacent row electrode pairs (X, Y). A recess groove 12A is formed in a portion of the dielectric layer 12 opposite each discharge area C2.

13 Claims, 8 Drawing Sheets

V1–V1 SECTION

FIRST EMBODIMENT

V1-V1 SECTION

W1-W1 SECTION

SECOND EMBODIMENT

V2-V2 SECTION

W2-W2 SECTION

THIRD EMBODIMENT

V3-V3 SECTION

W3-W3 SECTION

FOURTH EMBODIMENT

V4-V4 SECTION

FIFTH EMBODIMENT

PLASMA DISPLAY PANEL

BACKGROUND OF THE INVENTION

1. Field of the Invention

This invention relates to a matrix plasma display panel using a gas discharge for producing light emission.

The present application claims priority from Japanese Application No. 2002-29699, the disclosure of which is incorporated herein by reference for all purposes.

2. Description of the Related Art

Currently, AC matrix plasma display panels using a gas discharge for producing light emission (hereinafter referred to as "PDP") have appeared on the market as an oversized and slim display for color screen.

The matrix PDP has two substrates placed opposite each other with the interposition of a discharge space. One of the substrates has an inner surface on which a plurality of row electrode pairs are regularly arranged in a column direction and each extend in a row direction to form a display line, and a dielectric layer covers the row electrode pairs. The other substrate has an inner surface on which a plurality of column electrodes are regularly arranged in the row direction and each extends in the column direction to intersect the row electrode pairs and form discharge cells in the discharge space at the respective intersections, and a phosphor layer is placed in each of the discharge cells.

An addressing discharge is produced between one row electrode of the row electrode pair and the column electrode to generate wall charges on the dielectric layer in each of the selected discharge cells out of the discharge cells in a matrix array. Then, a sustaining discharge is produced between the row electrode pairs located in each of the discharge cells having the wall charges formed therein, to allow the phosphor layer to emit light for generation of an image on the panel surface.

Relating to such a PDP, prior to the present application, the applicant of the present application has suggested the PDP which includes a partition wall provided between the two opposite substrates and having vertical walls extending in the column direction and transverse walls extending in the row direction to partition the discharge space into row and column discharge cells in a matrix, in which the two transverse walls are placed between the adjacent discharge cells in the column direction to form, independently of a first discharge cell providing for a sustaining discharge for light emission, a second discharge cell provided between the two transverse walls concerned and opposite the back to back positioned row electrodes of the adjacent row electrode pairs for a priming discharge and a reset discharge.

In the suggested PDP, the reset discharge is produced within the second discharge cell formed separately from the first discharge cell in order to prevent a displayed image from subjecting to influences of the light emission generated by the reset discharge. And also, the priming discharge is produced within the second discharge cell and priming particles (similar to a pilot light) caused by the priming discharge spread out into the first discharge cell adjacent to the second discharge cell concerned in the column direction, to provide the so-called priming effect for triggering the sustaining discharge in the first discharge cell for generating an image.

The suggested PDP is designed such that the sustaining discharge within the first discharge cell is developed in a surface discharge mode on a flat inner face of the dielectric layer covering the row electrode pairs in order to reduce degradation of the phosphor layer due to the ion bombardment during a discharge for an long life thereof, and likewise, the reset discharge and priming discharge within the second discharge cell are developed in the surface discharge mode on a flat inner face of the dielectric layer facing the second discharge cell.

However, the operation in the surface discharge mode for the reset discharge and the priming discharge requires a higher driving voltage as compared with that in the operation in an opposite discharge mode for them, leading to a problem of an inevitable use of an expensive circuit component capable of withstanding a high voltage.

SUMMARY OF THE INVENTION

The present invention has been made to solve the problem associated with the surface-discharge matrix plasma display panels as described above.

Accordingly, it is an object of the present invention to provide a surface-discharge-type matrix plasma display panel capable of causing a discharge at low driving voltage within a discharge area formed separately from a discharge cell providing for a sustaining discharge for light emission.

To attain this object, the present invention provides a plasma display panel including: a pair of substrates opposite to each other with a discharge space interposed therebetween; a plurality of row electrode pairs regularly arranged on an inner surface of one substrate of the pair of the substrates in a column direction, and each extending in a row direction to form a display line and being constituted by row electrodes; a dielectric layer provided on the inner surface of the one substrate to cover the row electrode pairs: a plurality of column electrodes regularly arranged on an inner surface of the other substrate of the pair of the substrates in the row direction, and each extending in the column direction to intersect the row electrode pairs and form unit light-emitting areas in the discharge space at the respective intersections. The plasma display panel according to a first feature of the present invention comprises: a discharge area provided between adjacent unit light-emitting areas of the unit light-emitting areas in the column direction for producing a discharge between the row electrodes, positioned back to back with each other, of the adjacent row electrode pairs; and a recess formed in a portion of the dielectric layer facing the discharge area.

In the plasma display panel of the first feature, a reset discharge for forming wall charges on the dielectric layer or erasing wall charges existing on the dielectric layer in all of the unit light-emitting areas and a priming discharge for generating priming particles are created between the back to back row electrodes of the adjacent row electrode pairs in each discharge area formed between the adjacent unit light-emitting areas in the column direction.

At this point, although the reset and priming discharges are caused on the face of the dielectric layer facing the discharge area, these discharges are developed in a mode close to an opposite discharge mode within the recess formed in the portion of the dielectric layer in which these discharges are caused.

According to the first feature, the discharge occurs in a mode close to an opposite discharge mode as compared to a discharge occurring in a surface discharge mode on the flat face of the dielectric layer, and is thus increased in electric field strength. For this reason, the present invention achieves a decrease in driving voltage required for causing a discharge in the discharge area formed between the adjacent unit light-emitting areas in the column direction as compared to that required in prior art surface-discharge-type plasma display panels, to eliminate the need for expensive circuit components withstanding high voltage.

Further, the present invention achieves a reduction in driving voltage for causing the reset discharge in the discharge area, to promise the plasma display panel improved in dark contrast.

To attain the aforementioned object, the plasma display panel according to a second feature has, in addition to the configuration of the first feature, a configuration that the recess is formed in a band-like shape extending in parallel to the row direction in a position opposite a region between the row electrodes, positioned back to back with each other, of the adjacent row electrode pairs.

According to the second feature, a discharge in the discharge area formed between the adjacent unit light-emitting areas in the column direction is developed in a mode close to an opposite discharge mode within the band-shaped recess formed in the dielectric layer in parallel to the row direction. This design allows the surface-discharge-type plasma display panel to increase an electric field strength of a discharge occurring in the discharge area, to provide a decreased driving voltage for the discharge.

To attain the aforementioned object, the plasma display panel according to a third feature comprises, in addition to the configuration of the first feature, a protrusion protruding from a portion of the dielectric layer opposite each of the row electrodes of each row electrode pair toward the other substrate, wherein the recess is formed in a portion of the dielectric layer sandwiched between the protrusions.

According to the third feature, a discharge in the discharge area formed between the adjacent unit light-emitting areas in the column direction occurs within the recess formed in the portion of the dielectric layer facing the discharge area. The recess is formed in a position sandwiched between the protrusions each formed on the portion of the dielectric layer opposite the row electrode. As a result, the discharge in the recess is developed in a mode increasingly close to an opposite discharge mode. This design allows the surface-discharge-type plasma display panel to further increase an electric field strength of a discharge occurring in the discharge area, to provide a decreased driving voltage for the discharge.

To attain the aforementioned object, the plasma display panel according to a fourth feature has, in addition to the configuration of the first feature, a configuration that the recess is formed separately in each interval between adjacent unit light-emitting areas of the unit light-emitting areas in the column direction.

According to the fourth feature, a discharge in the discharge area formed between the adjacent unit light-emitting areas in the column direction is developed in a mode close to an opposite discharge mode within the recess formed separately in each interval between adjacent unit light-emitting areas in the column direction. This design allows the surface-discharge-type plasma display panel to increase an electric field strength of a discharge occurring in the discharge area, and therefore provides a decreased driving voltage for the discharge.

To attain the aforementioned object, the plasma display panel according to a fifth feature has, in addition to the configuration of the first feature, a configuration that each of row electrodes constituting each row electrode pair comprises: an electrode body extending in the row direction; and transparent electrodes each extending from the electrode body in the column direction for each unit light-emitting area and jutting from the electrode body in a direction of another row electrode, positioned back to back with the row electrode concerned, of another row electrode pair adjacent to the row electrode pair concerned, the jutting portion of the transparent electrode being, in a position opposite the recess, opposite to another jutting portion of a corresponding transparent electrode of the another row electrode with a predetermined gap interposed between the jutting portions.

According to the fifth feature, a discharge is caused in the discharge area formed between the adjacent unit light-emitting areas in the column direction. The discharge is developed in a mode close to an opposite discharge mode in the portion of the dielectric layer having the recess formed, as compared to a surface discharge mode typically employed in the prior art. Thus, the discharge has an increased electric field strength. Due to the electric field strength increased, driving voltage required for causing the discharge is decreased as compared to the prior art surface-discharge-type plasma display panel, and therefore the need for expensive circuit components withstanding high voltage is eliminated.

The discharge in the discharge area is created between the projections of the respective transparent electrodes of the row electrodes positioned back to back with each other, the projections jutting from the respective electrode bodies into a region opposite the discharge area. As a result, the discharge is initiated at a low discharge starting voltage.

To attain the aforementioned object, the plasma display panel according to a sixth feature comprises, in addition to the configuration of the first feature, a recess formed in a portion of the one substrate facing the discharge area, with a part of each of the row electrodes, positioned back to back with each other, of the adjacent row electrode pairs being situated within the recess.

According to the sixth feature, the recess receiving a part of the row electrode is formed in a position opposite the discharge area, formed between the adjacent unit light-emitting areas in the column direction, on the one substrate having the row electrode pairs formed. Hence, when the dielectric layer is formed on the inner surface of the one substrate by use of printing techniques of patterning thick film materials or the like, the recess is formed in the portion of the formed dielectric layer corresponding to the discharge area.

Due to the recess formed in the dielectric layer, the discharge in the discharge area is developed in a mode close to an opposite discharge mode.

To attain the aforementioned object, the plasma display panel according to a seventh feature has, in addition to the configuration of the first feature, a configuration that a center line of the recess is offset from a center line of a region between the row electrodes, positioned back to back with each other, of the adjacent row electrode pairs.

According to the seventh feature, when the center line of the recess formed in the portion of the dielectric layer facing the discharge area formed between the adjacent unit light-emitting areas in the column direction, is offset from the center line of the region between the row electrodes serving to cause a discharge within the discharge area, the discharge between the row electrodes occurs in the recess of the dielectric layer in a mode close to the opposite discharge mode, resulting in a reduction in driving voltage for the discharge.

These and other objects and features of the present invention will become more apparent from the following detailed description with reference to the accompanying drawings.

DETAILED DESCRIPTION OF THE PREFERRED EMBODIMENT

Preferred embodiments according to the present invention will be described hereinafter in detail with reference to the accompanying drawings.

Figure 1:
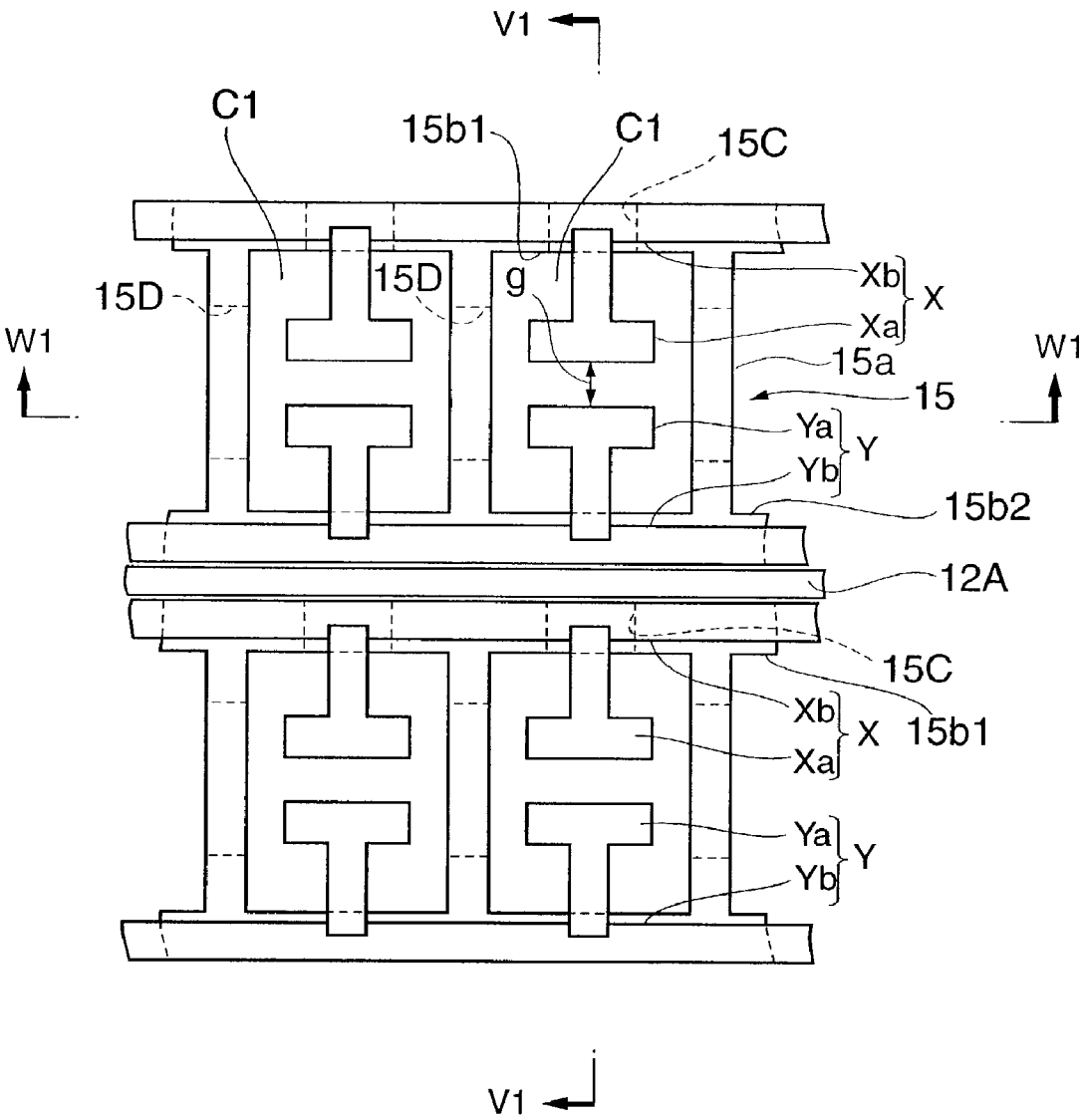
FIG. 1 is a schematic front view illustrating a first embodiment according to the present invention.
Figure 2:
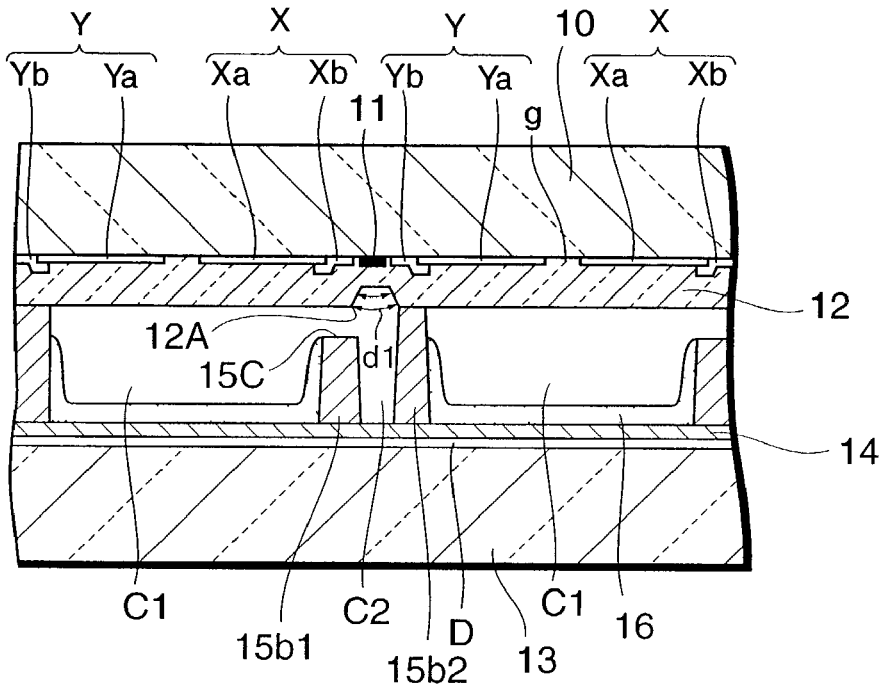
FIG. 2 is a sectional view taken along the V1—V1 line of FIG. 1.
Figure 3:
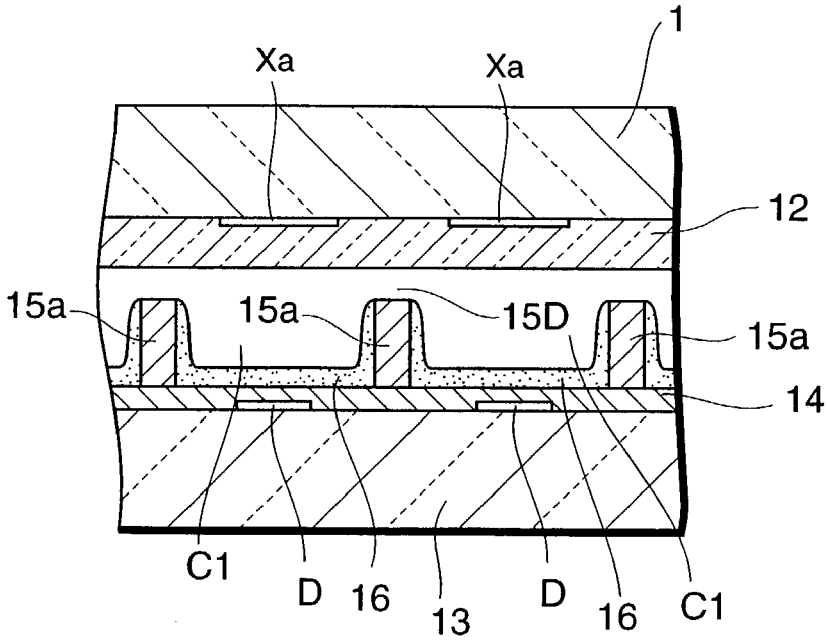
FIG. 3 is a sectional view taken along the W1—W1 line of FIG. 1.

FIG. 1 to FIG. 3 illustrate a first embodiment of a plasma display panel (hereinafter referred to as "PDP") according to the present invention, FIG. 1 being a schematic front view of the PDP, FIG. 2 a sectional view taken along the V1—V1 line of FIG. 1, and FIG. 3 a sectional view taken along the W1—W1 line of FIG. 1.

In FIGS. 1 to 3, a front glass substrate 10 serving as the display surface of the PDP is provided on its back surface with a plurality of row electrode pairs (X, Y) which are arranged in parallel, each extending in a row direction of the front glass substrate 10 (the right-left direction in FIG. 1). Row electrodes X and Y of each row electrode pair form a display line (row) in a matrix display.

Each of the row electrodes X includes transparent electrodes Xa each of which is formed of a transparent conductive film made of ITO or the like formed in a letter-T shape, and a bus electrode Xb which is formed of a metal film extending in the row direction of the front glass substrate 10 and connected to a narrowed base end of each of the transparent electrodes Xa.

Likewise, each of the row electrodes Y includes transparent electrodes Ya each of which is formed of a transparent conductive film made of ITO or the like formed in a letter-T shape, and a bus electrode Yb which is formed of a metal film extending in the row direction of the front glass substrate 10 and connected to a narrowed base end of each of the transparent electrodes Ya.

In each row electrode pair (X, Y), the transparent electrodes Xa and Ya are regularly arranged along the corresponding bus electrodes Xb and Yb. The transparent electrodes Xa and Ya paired extend toward each other such that leading ends of widened portions of the respective electrodes Xa and Ya are opposite to each other with an interposed discharge gap g having a required width.

On the back surfaces of the front glass substrate 10, a black-colored light absorption layer 11 extends in the row direction between the bus electrodes Xb and Yb, positioned back to back with each other, of the adjacent, respective row electrode pairs.

On the back surface of the front glass substrate 10, a dielectric layer 12 is also formed to cover the row electrode pairs (X, Y). On the back surface of the dielectric layer 12, a protective layer (not shown) made of MgO is formed.

The front glass substrate 10 is situated in parallel to a back glass substrate 13 having a surface facing the display surface on which column electrodes D are arranged in parallel at predetermined intervals and each extend in a direction at right angles to the row electrode pairs (X, Y) (or the column direction) in a position opposite the paired transparent electrodes Xa and Ya of each row electrode pair (X, Y).

On the surface of the back glass substrate 13 on the display surface side, a column-electrode protective layer 14 covers the column electrodes D, and partition walls 15 are formed on the protective layer 14.

The partition wall 15 is constructed in a ladder-shaped pattern by: vertical walls 15*a* each extending in the column direction in a position between adjacent column electrodes D arranged in parallel to each other; a first transverse wall 15*b*1 extending in the row direction in a position opposite the bus electrode Xb of the row electrode X; and a second transverse wall 15*b*2 extending in the row direction in a position opposite the bus electrode Yb of the row electrode Y. The ladder-patterned partition walls 15 partition a space defined between the front and back glass substrates 10 and 13 into quadrangles each corresponding to the paired transparent electrodes Xa and Ya of each row electrode pair (X, Y), to form a matrix array of display discharge cells C1.

The first transverse wall 15*b*1 and the second transverse wall 15*b*2 of the respective ladder-patterned partition walls 15 adjacent to each other are located back to back and spaced from each other. Between the back to back first and second transverse walls 15*b*1 and 15*b*2, a discharge area C2 is formed opposite a region between the back to back bus electrodes Xb and Yb of the respective row electrode pairs (X, Y) adjacent to each other.

A discharge area C2 communicates with the display discharge cell C1 adjacent to the area C2 with the first transverse wall 15*b*1 interposed between them by means of a communicating groove 15C formed in the interposed first transverse wall 15*b*1, but is blocked from another display discharge cell C1 adjacent to the area C2 with the second transverse wall 15*b*2 interposed between them because the leading end of the interposed second transverse wall 15*b*2 is in contact with the dielectric layer 12.

The dielectric layer 12 has a band-shaped recess groove 12A extending in the row direction in portion of the layer 12 facing the discharge areas C2. Accordingly, the dielectric layer 12 has a thickness in the portion facing the discharge area C2 smaller than that in other portions.

A phosphor layer 16 is provided to cover five faces facing each display discharge cell C1: a face of the column-electrode dielectric layer 14 and the four inner side faces of the vertical walls 15*a* and transverse walls 15*b*1 and 15*b*2 of the partition wall 15. The phosphor layers 16 are arranged in order of a red color, a green color and a blue color along the row direction for each display discharge cell C1.

The display discharge cells C1 and discharge areas C2 are filled with a discharge gas.

In the PDP, in order to form wall charges on the dielectric layer 12 in all of the display discharge cells C1 or to erase wall charges existing on the dielectric layer 12, a reset discharge is produced between the back to back bus electrodes Xb and Yb of the adjacent row electrode pairs (X, Y) within each discharge area C2.

In the face of an addressing discharge produced between the row electrode Y and the column electrode D for selectively erasing the wall charges existing on the dielectric layer 12 in the display discharge cells C1 or selectively forming wall charges on the dielectric layer 12, a priming discharge is produced also between the back to back bus electrodes Xb and Yb of the adjacent row electrode pairs (X, Y) within the discharge areas C2.

Due to the recess groove 12A formed in the portion of the dielectric layer 12 facing each discharge area C2 experiencing the reset discharge and the priming discharge, the major portion of a discharge d1 in the discharge area C2 occurs in the recess groove 12A as illustrated in FIG. 2.

Thus, the discharge d1 in the discharge area C2 is developed in a mode close to an opposite discharge mode as compared to a discharge being caused on a flat face of the dielectric layer in a surface discharge mode, and thus has an increased electric field strength.

For this reason, driving voltage for the reset discharge and the priming discharge in the PDP of the present invention is decreased as compared to that required in prior art surface discharge type PDPs. The present invention therefore eliminates the need for use of an expensive circuit component capable of withstanding high voltage. In addition, it is expected to improve dark contrast because of a reduction in driving voltage for the reset discharge.

For reference, the closer to an angle of 90 degrees to the front glass substrate 10 each side face of the recess groove 12A is, the closer to an opposite discharge mode the reset discharge and the priming discharge becomes, and in turn the smaller the driving voltage for the discharge becomes.

Charged particles generated during the reset discharge in the discharge area C2 flow through a communication groove 15C formed in the first transverse wall 15*b*1 into the display discharge cell C1 adjacent to the discharge area C2 concerned, to reset the display discharge cell C1 (to form the wall charges or erase the wall charges existing on the dielectric layer 12). Likewise, priming particles generated during the priming discharge in the discharge area C2 flow through the communication groove 15C into the display discharge cell C1 adjacent to the discharge area C2 concerned, to provide the priming effect of triggering a sustaining discharge between the transparent electrodes Xa, Ya of the row electrodes X, Y.

The PDP includes a light absorption layer 11 formed between the back to back bus electrodes Xb and Yb to cover a face of the discharge area C2 facing the display surface, whereby the light generated by the reset discharge or the priming discharge within the discharge area C2 is prevented from leaking toward the image display surface, and consequently from having an adverse effect upon the contrast in the image.

In the first embodiment, a communication groove 15D is formed in the vertical wall 15*a* of the partition wall 15 to establish a communication between the display discharge cells C1 adjacent to each other in the row direction. The communication groove 15D is provided for the passage of air exhausted from and of the discharge gas fed into between the substrates in the manufacturing process for the PDP, the passage of the charged particles transferring to produce the priming effect in the operation of the PDP, and the like.

Figure 4:
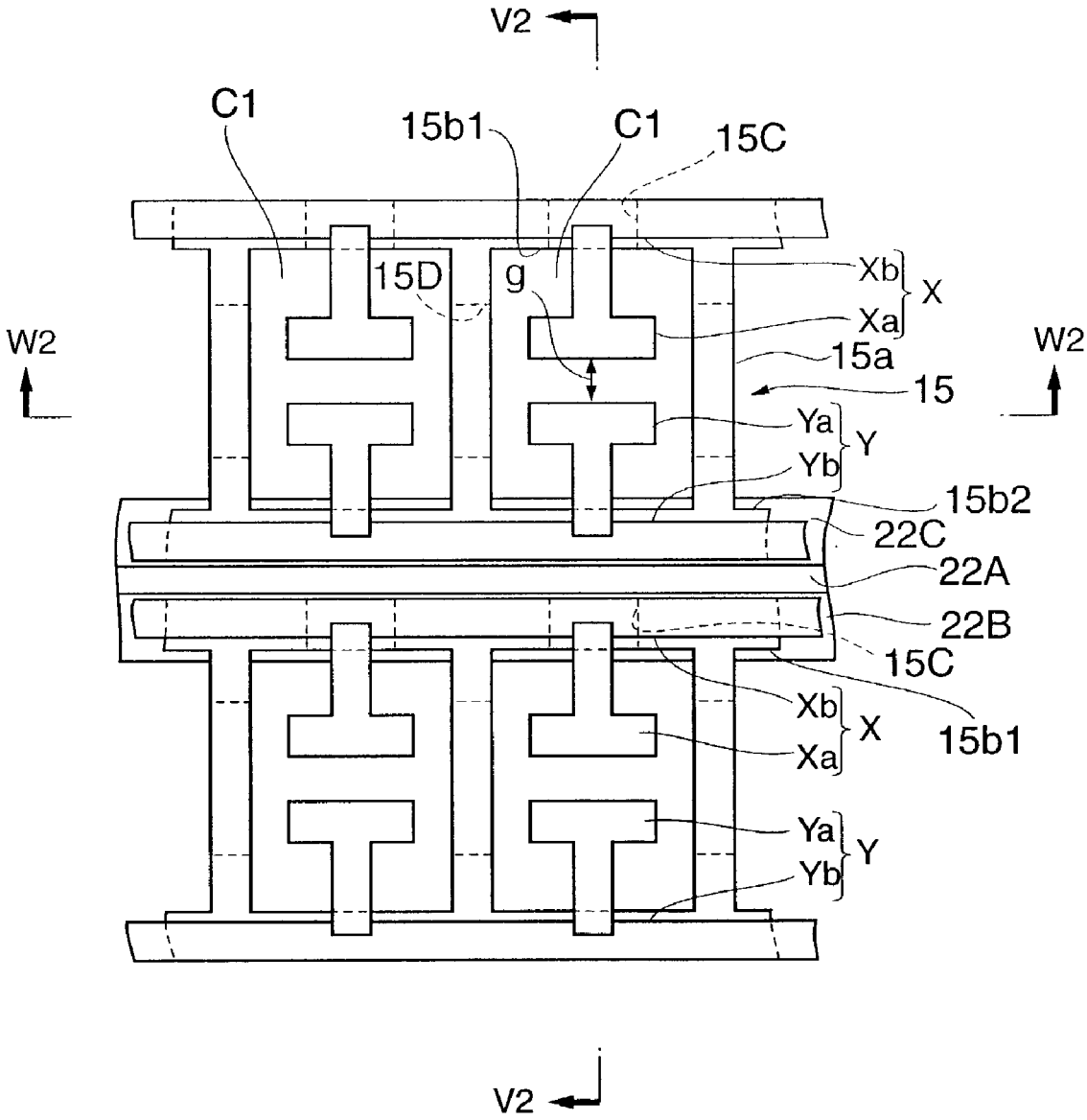
FIG. 4 is a schematic front view illustrating a second embodiment according to the present invention.
Figure 5:
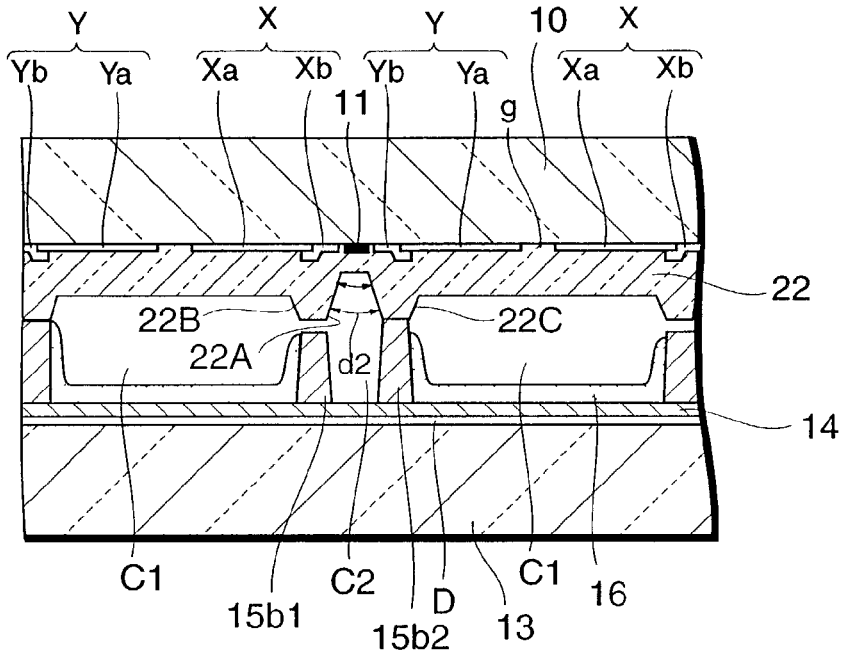
FIG. 5 is a sectional view taken along the V2—V2 line of FIG. 4.
Figure 6:
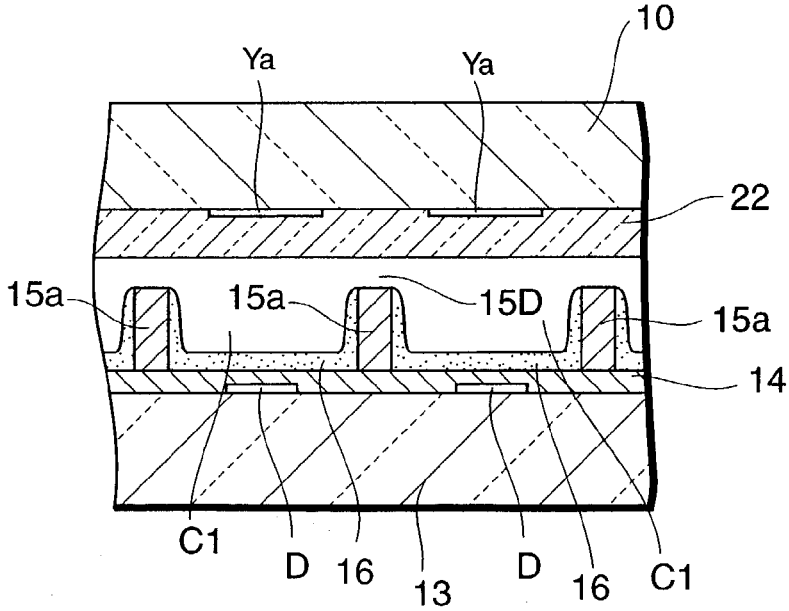
FIG. 6 is a sectional view taken along the W2—W2 line of FIG. 4.

FIGS. 4 to 6 illustrate a second embodiment of the plasma display panel according to the present invention, FIG. 4 being a schematic front view of the PDP, FIG. 5 a sectional view taken along the V2—V2 line of FIG. 4, and FIG. 6 a sectional view taken along the W2—W2 line of FIG. 4.

The PDP of the second embodiment includes a dielectric layer 22 having a band-shaped protrusion stripe 22B formed on portion of the layer 22 opposite each first transverse wall 15*b*1, and also a band-shaped protrusion stripe 22C formed on portion of the layer 22 opposite each second transverse wall 15*b*2, each of the protrusion stripes 22B and 22C extending in the row direction and projecting from the back face of the layer 22 in the direction of the back glass substrate 13. As a result, a recess groove 22A corresponding to the recess groove 12A in the first embodiment is formed in portion of the dielectric layer 22 opposite the discharge areas C2 and between the protrusion stripes 22B and 22C.

The configuration of other components in the second embodiment is similar to that of the PDP in the first embodiment, and the same reference numerals as in the first embodiment are used.

As in the PDP of the first embodiment, in the PDP of the second embodiment, the reset discharge and the priming discharge are caused in the discharge area C2, and the major portion of the discharge d2 in the discharge area C2 occurs in the recess groove 22A sandwiched between the protrusion stripes 22B and 22C, as illustrated in FIG. 5.

Hence, the discharge d2 in the discharge area C2 is developed in a mode close to an opposite discharge mode as compared to a discharge being caused on a flat face of the dielectric layer in a surface discharge mode, and thus has an increased electric field strength. Therefore, the PDP of the second embodiment requires a driving voltage for the reset discharge and the priming discharge smaller than that required in prior art surface discharge type PDPs. In addition, it is expected to improve dark contrast because of a reduction in driving voltage for the reset discharge.

In the PDP of the second embodiment, the recess groove 22A is sandwiched between the protrusion stripes 22B and 22C so as to has a depth greater than that of the recess groove 12A formed in the PDP of the first embodiment. Due to the increased depth, the discharge d2 in the recess groove 22A occurs in a mode closer to the opposite discharge mode than that in the groove 12A, resulting in a further increase in electric field strength of the discharge and thus a further decrease in driving voltage.

Figure 7:
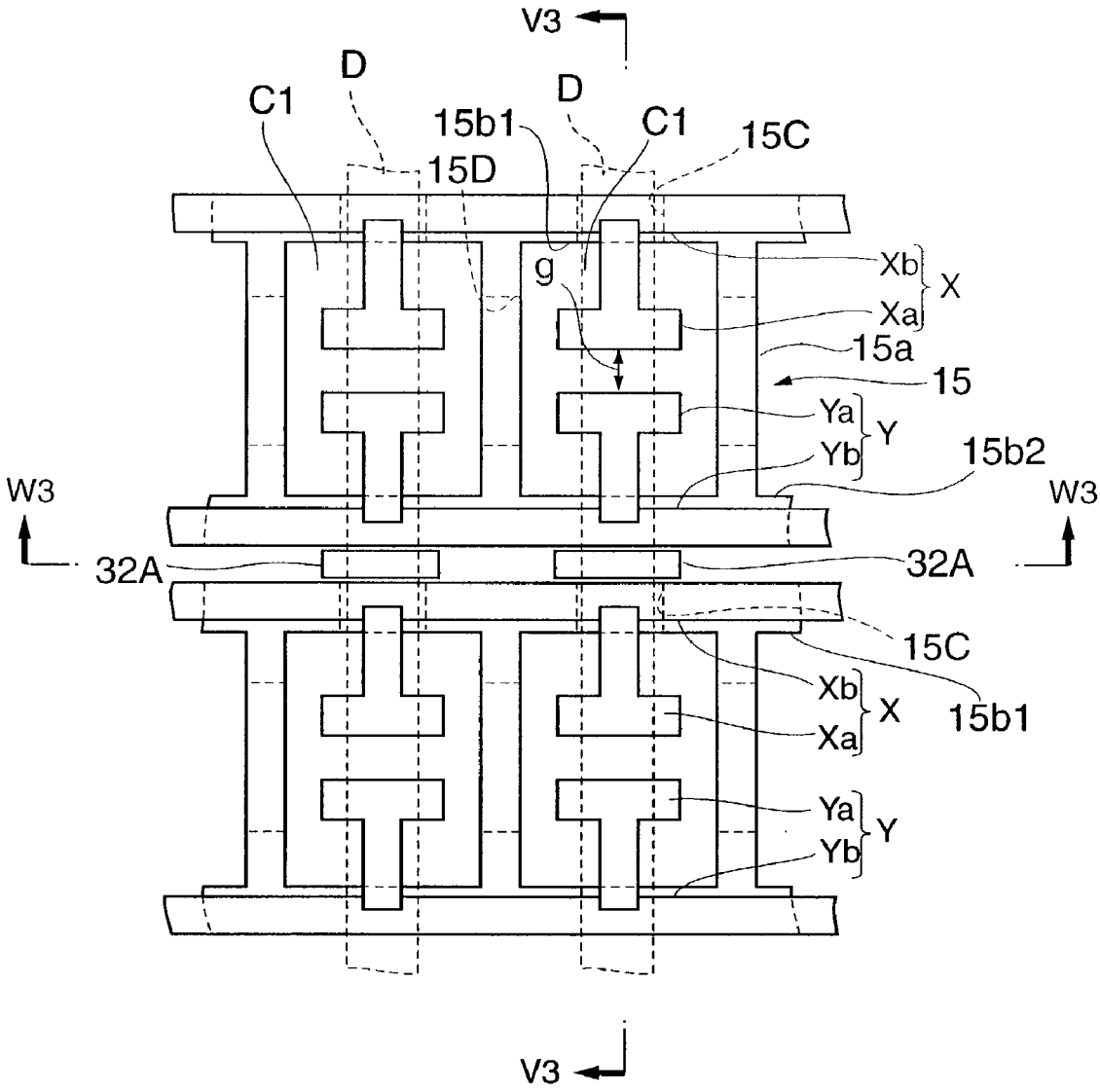
FIG. 7 is a schematic front view illustrating a third embodiment according to the present invention.
Figure 8:
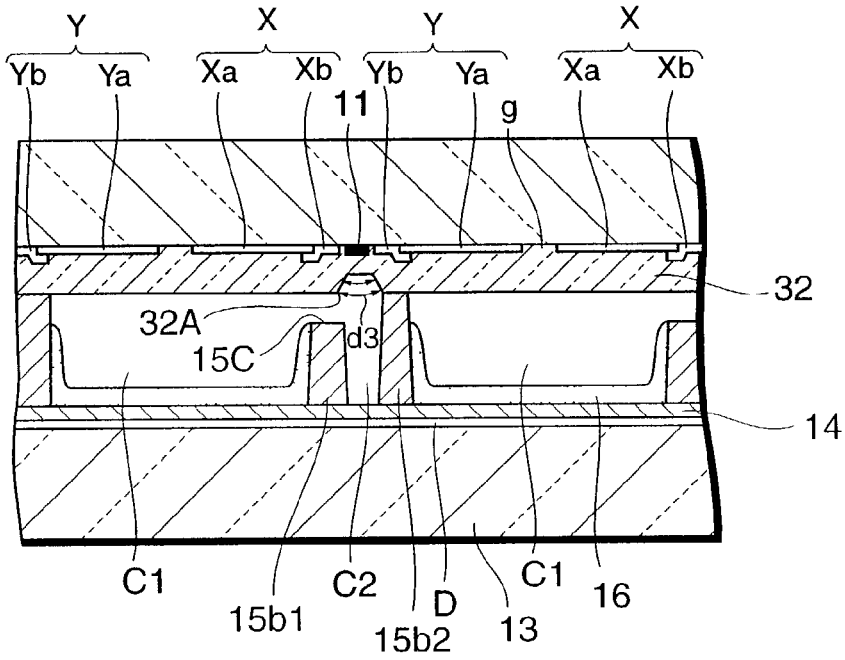
FIG. 8 is a sectional view taken along the V3—V3 line of FIG. 7.
Figure 9:
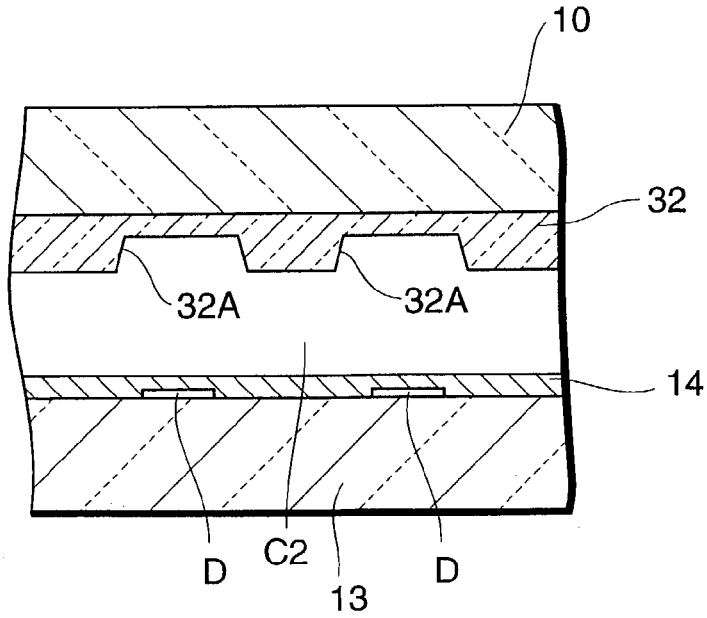
FIG. 9 is a sectional view taken along the W3—W3 line of FIG. 7.

FIGS. 7 to 9 illustrate a third embodiment of the PDP according to the present invention, FIG. 7 being a schematic front view of the PDP, FIG. 8 a sectional view taken along the V3—V3 line in FIG. 7, and FIG. 9 a sectional view taken along the W3—W3 line of FIG. 7.

The PDP in the first embodiment includes the band-shaped recess groove 12A extending in the row direction, whereas the PDP in the third embodiment includes a recess groove 32A formed separately on a portion of a dielectric layer 32 opposite to the column electrode D in each discharge area C2.

The configuration of other components in the third embodiment is similar to that of the PDP in the first embodiment, and the same reference numerals as in the first embodiment are used.

As in the PDP in the first embodiment, in the reset discharge and the priming discharge created in the discharge area C2 in the PDP in the third embodiment, as illustrated in FIG. 8, the discharge d3 is developed in the recess groove 32A formed in the dielectric layer 32 in a mode close to an opposite discharge mode rather than a surface discharge mode in prior art PDPs, to increase an electric field strength. Due to the increased electric field strength, a lower driving voltage is advantageously required for producing the reset discharge and the addressing discharge as compared with that required in the prior art PDPs adopting the surface discharge mode, resulting in elimination of a need of expensive circuit components withstanding high voltage.

Figure 10:
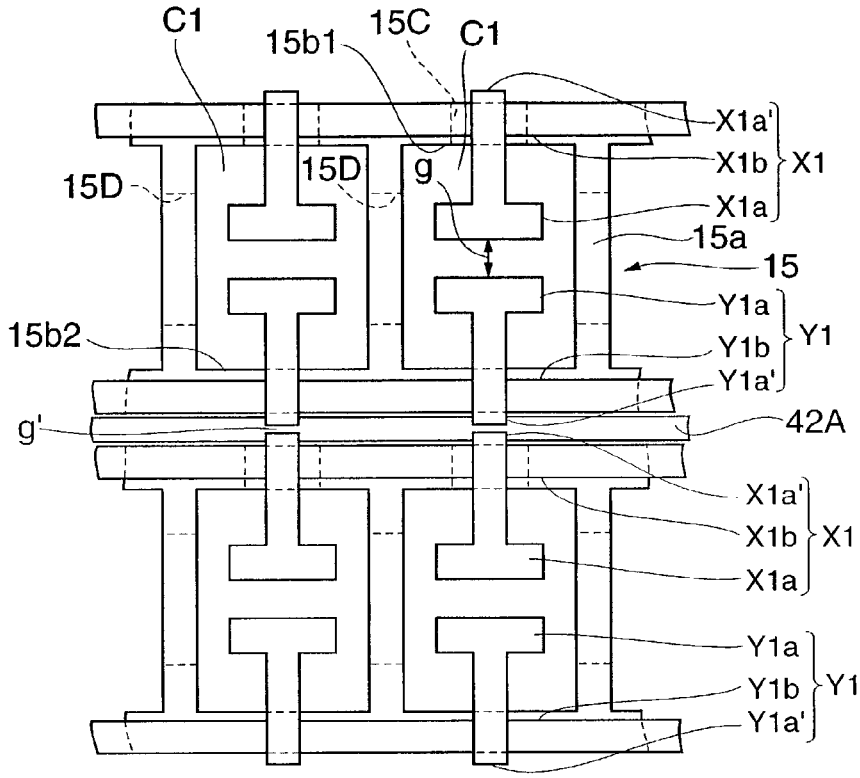
FIG. 10 is a schematic front view illustrating a fourth embodiment according to the present invention.
Figure 11:
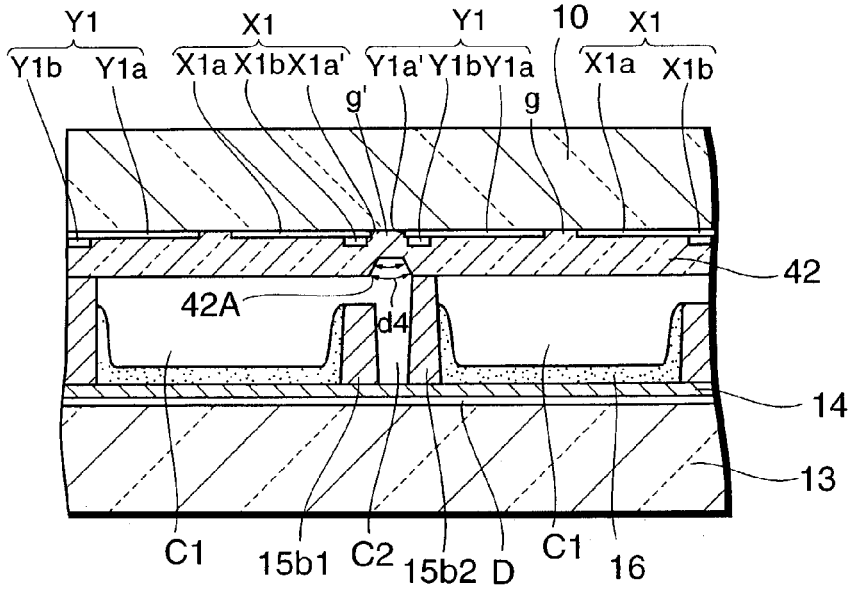
FIG. 11 is a sectional view taken along the V4—V4 line of FIG. 10.

FIGS. 10 and 11 illustrate a fourth embodiment of the PDP according to the present invention, FIG. 10 being a schematic front view of the PDP, and FIG. 11 a sectional view taken along the V4—V4 line of FIG. 10.

The PDP in the fourth embodiment is constructed such that a base end X1*a*' of a transparent electrode X1*a* of a row electrode X1 protrude from a bus electrode X1*b* toward a row electrode Y1 adjacent to the row electrode X1 in a back to back position, and likewise a base end Y1*a*' of a transparent electrode Y1*a* of a row electrode Y1 protrude from a bus electrode Y1*b* toward a row electrode X1 adjacent to the row electrode Y1 in a back to back position. The base ends X1*a*' and Y1*a*' of the respective back to back row electrodes X and Y are opposite to each other with the interposition of a discharge gap g'.

The configuration of other components in the fourth embodiment is similar to that of the PDP in the first embodiment, and the same reference numerals as in the first embodiment are used.

As in the PDP in the first embodiment, in the reset discharge and the priming discharge caused in the discharge area C2 in the PDP in the fourth embodiment, as illustrated in FIG. 11, the discharge d4 is developed in a recess groove 42A formed in a dielectric layer 42 in a mode close to an opposite discharge mode rather than a surface discharge mode in prior art PDPs, to increase an electric field strength. Due to the increased electric field strength, a lower driving voltage is advantageously required for producing the reset discharge and the addressing discharge as compared with that required in the prior art PDPs adopting the surface discharge mode, resulting in elimination of a need of expensive circuit components withstanding high voltage.

In the above PDP, the reset discharge and the priming discharge in the discharge cell C2 is created between the base ends X1*a*' and Y1*a*' protruding from the respective bus electrodes Xb, Yb of the back to back row electrodes X and Y into a region opposite the discharge area C2. This construction according to the fourth embodiment allows the initiation of a discharge at a low voltage.

Figure 12:
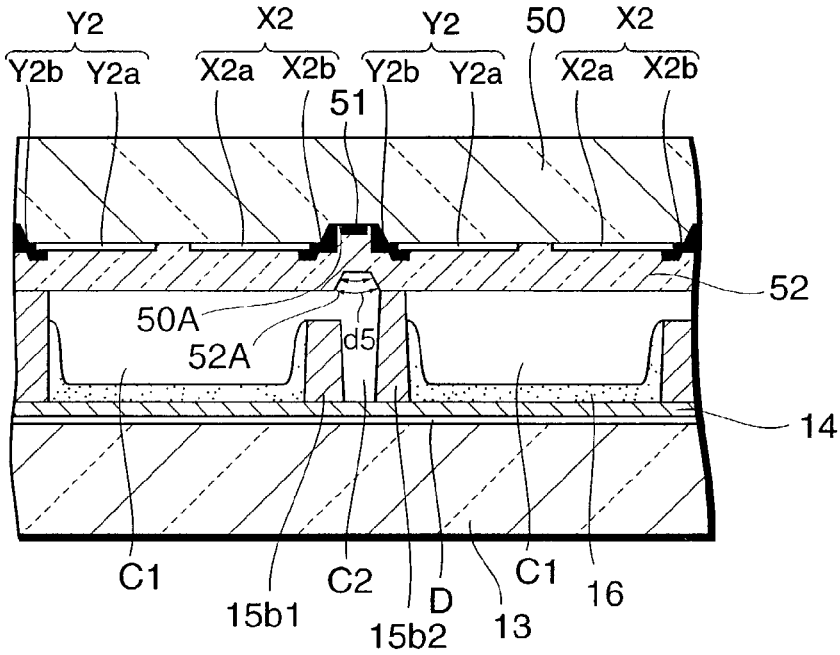
FIG. 12 is a schematic sectional view illustrating a fifth embodiment according to the present invention.

FIG. 12 is a sectional view illustrating a fifth embodiment of the PDP according to the present invention, which is taken along the same position as that in FIG. 2 of the first embodiment.

The PDP in the fifth embodiment includes a recess groove 50A extending in portion of a front glass substrate 50 opposite the discharge areas C2 along the row direction. Bus electrodes X2*b* and Y2*b* of the respective row electrodes X2 and Y2 are formed along the inner side face of the recess groove 50A, and also a light absorption layer 51 is formed inside the recess groove 50A.

The configuration of other components in the fifth embodiment is similar to that of the PDP in the first embodiment, and the same reference numerals as in the first embodiment are used.

In this manner the recess groove 50A opposite the discharge cells C2 is formed in the front glass substrate 50. Therefore, in the process of forming a dielectric layer 52 on the back surface of the front glass substrate 50 by use of printing techniques of patterning thick film materials or the like, the recess groove 52A is formed in the portion of the dielectric layer 52 corresponding to the discharge area C2. Thus, the recess groove 52A forms an opposite-discharge area to allow a discharge d5 in the discharge area C2 to occur in a mode close to an opposite discharge mode as illustrated in FIG. 12.

Figure 13:
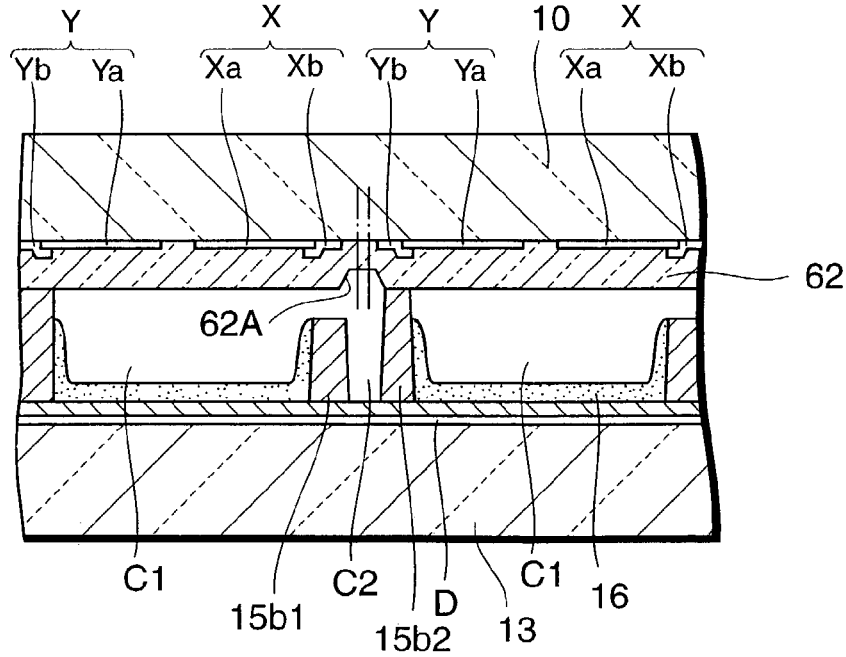
FIG. 13 is a schematic sectional view illustrating a modified example according to the present invention.

Each of the first to fifth embodiments mentioned thus far describes an exemplary construction in which the center line of a recess groove formed in a dielectric layer is aligned with the center line between adjacent bus electrodes in the back to back position. However, the center line of the recess groove formed in the dielectric layer may not be necessarily aligned with the center line of the back to back bus electrodes. For example, as in the case of a recess groove 62A of a dielectric layer 62 illustrated in FIG. 13, the center line of the recess groove 62A may offset from the center line between the back to back bus electrodes Xb, Yb.

Each of the foregoing embodiments can adopt various methods for forming the recess groove and the protrusion stripe on the dielectric layer, e.g., printing techniques of patterning thick film materials, photolithographic techniques of patterning a photosensitive glass paste, and the like.

Further, each of the foregoing embodiments according to the present invention describes the construction in which the display discharge cells are defined by the ladder-patterned partition wall, but the display discharge cells may be defined by band-patterned partition walls each extending in the column direction.

Still further, a communication between the display discharge cell C1 and the discharge area C2 can be established by a slit formed in the dielectric layer.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a pair of substrates opposite to each other with a discharge space interposed therebetween, a plurality of row electrode pairs, each being constituted by a pair of row electrodes, regularly arranged on an inner surface of one substrate of the pair of the substrates in a column direction, and each extending in a row direction to form a display line and being constituted by row electrodes, a dielectric layer provided on the inner surface of the one substrate to cover the row electrode pairs, and a plurality of column electrodes regularly arranged on an inner surface of the other substrate of the pair of the substrates in the row direction, and each extending in the column direction to intersect the row electrode pairs and form display discharge cells in the discharge space at the respective intersections, said plasma display panel comprising:

a discharge area provided between adjacent display discharge cells of said display discharge cells in the column direction for producing a discharge between the row electrodes, positioned back to back with each other, of the adjacent row electrode pairs in the column direction, a recess formed in a portion of said dielectric layer facing the discharge area; and a protrusion protruding from a portion of said dielectric layer opposite each of the row electrodes of each row electrode pair toward the other substrate;

wherein said recess is formed in a portion of the dielectric layer sandwiched between the protrusions.

2. A plasma display panel according to claim 1, wherein said recess is formed in a band-like shape extending in parallel to the row direction in a position opposite a region between the row electrodes, positioned back to back with each other, of the adjacent row electrode pairs.

3. A plasma display panel according to claim 1, wherein said recess is formed separately in each interval between adjacent unit light-emitting areas of the unit light-emitting areas in the column direction.

4. A plasma display panel according to claim 1, wherein each of row electrodes constituting each row electrode pair comprises:

an electrode body extending in the row direction; and transparent electrodes each extending from the electrode body in the column direction for each unit light-emitting area and jutting from the electrode body in a direction of another row electrode, positioned back to back with the row electrode concerned, of another row electrode pair adjacent to the row electrode pair concerned, the jutting portion of the transparent electrode being, in a position opposite said recess, opposite to another jutting portion of a corresponding transparent electrode of the another row electrode with a predetermined gap interposed between the jutting portions.

5. A plasma display panel according to claim 1, further comprising a recess formed in a portion of said one substrate facing said discharge area, a part of each of the row electrodes positioned back to back with each other, of the adjacent row electrode pairs being situated within the recess.

6. A plasma display panel according to claim 1, wherein a center line of said recess is offset from a center line of a region between the row electrodes, positioned back to back with each other, of the adjacent row electrode pairs.

7. A plasma display panel including a pair of substrates opposite to each other with a discharge space interposed therebetween, a plurality of row electrode pairs, each being constituted by a pair of row electrodes, regularly arranged on an inner surface of one substrate of the pair of the substrates in a column direction, and each extending in a row direction to form a display line and being constituted by row electrodes, a dielectric layer provided on the inner surface of the one substrate to cover the row electrode pairs, and a plurality of column electrodes regularly arranged on an inner surface of the other substrate of the pair of the substrates in the row direction, and each extending in the column direction to intersect the row electrode pairs and form display discharge cells in the discharge space at the respective intersections, said plasma display panel comprising:

a discharge area provided between adjacent display discharge cells of said display discharge cells in the column direction for producing a discharge between the row electrodes, positioned back to back with each other, of the adjacent row electrode pairs in the column direction;

a recess formed in a portion of said dielectric layer facing the discharge area; and a recess formed in a portion of said one substrate facing said discharge area, a part of each of the row electrodes, positioned back to back with each other, of the adjacent row electrode pairs being situated within the recess.

8. A plasma display panel according to claim 7, wherein said recess is formed in a band-like shape extending in parallel to the row direction in a position opposite a region between the row electrodes, positioned back to back with each other, of the adjacent row electrode pairs in the column direction.

9. A plasma display panel according to claim 7, further comprising a protrusion protruding from a portion of said dielectric layer opposite each of the row electrodes of each row electrode pair toward the other substrate, wherein said recess is formed in a portion of the dielectric layer sandwiched between the protrusions.

10. A plasma display panel according to claim 7, wherein said recess is formed separately in each interval between adjacent display discharge cells of the display discharge cells in the column direction.

11. A plasma display panel according to claim 7, wherein each of row electrodes constituting each row electrode pair comprises:

a bus electrode extending in the row direction; and transparent electrodes each extending from the bus electrode in the column direction for each display discharge cell, each of said transparent electrodes jutting from the bus electrode in a direction of another row electrode, positioned back to back with the row electrode concerned, of another row electrode pair adjacent to the row electrode pair concerned, the jutting portion of the transparent electrode being, in a position opposite said recess, opposite to another jutting portion of a corresponding transparent electrode of the another row electrode with a predetermined gap interposed between the jutting portions.

12. A plasma display panel according to claim 7, wherein a center line of said recess is offset from a center line of a region between the row electrodes, positioned back to back with each other, of the adjacent row electrode pairs.

13. A plasma display panel including a pair of substrates opposite to each other with a discharge space interposed there between, a plurality of row electrode pairs, each being constituted by a pair of row electrodes, regularly arranged on an inner surface of one substrate of the pair of the substrates in a column direction, and each extending in a row direction to form a display line and being constituted by row electrodes, a dielectric layer provided on the inner surface of the one substrate to cover the row electrode pairs, and a plurality of column electrodes regularly arranged on an inner surface of the other substrate of the pair of the substrates in the row direction, and each extending in the column direction to intersect the row electrode pairs and form display discharge cells in the discharge space at the respective intersections, said plasma display panel comprising:

a discharge area provided between adjacent display discharge cells of said display discharge cells in the column direction for producing a discharge between the row electrodes, positioned back to back with each other, of the adjacent row electrode pairs in the column direction, wherein said dielectric layer has first portions that respectively facing the display discharge cell, second portions that respectively facing the discharge area, having a thickness thinner than the first portion and forming a recess, and third portions that respectively facing a portion between the display discharge cell and the discharge area, having a thickness thicker than the first portion and forming a protrusion.

* * * * *